United States Patent [19]

Drucker

[11] Patent Number: 4,548,050

[45] Date of Patent: Oct. 22, 1985

[54] HIGH EFFICIENCY FAN COIL UNIT

[75] Inventor: Alan S. Drucker, Dewitt, N.Y.

[73] Assignee: Carrier Corporation, Syracuse, N.Y.

[21] Appl. No.: 499,619

[22] Filed: May 31, 1983

[51] Int. Cl.[4] ..... F25D 21/14

[52] U.S. Cl. ..... 62/291; 62/285

[58] Field of Search ..... 62/80, 81, 171, 263, 62/291, 285, 272; 165/111

[56] References Cited

U.S. PATENT DOCUMENTS

| | | | |
|---|---|---|---|
| 175,291 | 3/1876 | Lount | 62/82 |
| 2,899,803 | 8/1959 | Paley | 62/291 |
| 3,128,610 | 4/1964 | Moore | 62/263 |
| 3,491,550 | 1/1970 | Cavis | 62/285 |
| 3,524,328 | 8/1970 | Schuster | 62/285 |
| 3,596,475 | 8/1971 | Berger | 62/285 |
| 3,902,551 | 9/1975 | Lim et al. | 165/111 |

*Primary Examiner*—Henry Bennett

*Attorney, Agent, or Firm*—Robert H. Kelly

[57] ABSTRACT

A blow-through fan coil unit is disclosed which includes a housing, a heat exchanger mounted to extend across the housing and a blower assembly for directing air therethrough. The heat exchanger is mounted at a relatively small angle to horizontal such that condensate drips across the entire width of the heat exchanger. A combination fan deck and condensate collection pan together with a fan scroll are utilized to collect condensate which drips from the heat exchanger.

7 Claims, 2 Drawing Figures

HIGH EFFICIENCY FAN COIL UNIT

BACKGROUND OF THE INVENTION

1. Field of the Invention

This invention relates in general to fan coil units. More particularly this invention concerns a heat transfer unit including a fan for circulating the air in heat exchange relation with a heat exchanger.

2. Prior Art

In a conventional residential split system air conditioning unit the condenser of the refrigeration circuit is located exterior of the residence. Typically, this unit has a condensing coil, a fan for circulating outdoor ambient air over the condensing coil and may additionally have a compressor, reversing valves and various controls. The residential split system further includes an indoor unit having an evaporator for transferring heat energy from the indoor air to be conditioned to the refrigerant flowing through the evaporator and a fan for circulating the indoor air in heat exchange relation with the evaporator. This type of unit is referred to as a fan coil unit.

Generally, when a heat exchanger is used to effect cooling of air the heat exchanger will be connected to a source of a relatively cold fluid medium such as water or to a source of suitable refrigerant capable of changing state from liquid to a gas to absorb heat energy. The air to be cooled is routed over the heat exchanger in heat transfer relation with the relatively cold fluid media. This relative cold medium absorbs heat energy from the air thereby cooling the air to the desired temperature level. Oftentimes, the air is cooled below its dew point such that condensate collects on the surfaces of the heat exchanger. In a plate fin heat exchanger these surfaces are primarily the fins mounted to the tubes defining a fluid path for the refrigerant.

If the condensate falls randomly throughout the heat exchange assembly this may result in puddles of condensate forming at various locations within the unit. These puddles of condensate not only provide unwanted moisture within the unit but also serve to provide a catalyst for increasing corrosion and may create other problems in the unit. Many methods of collecting and diverting this condensate have been used.

One method of attacking the problem of condensate collecting throughout the unit is to mount the heat exchanger at a sufficient angle to horizontal that the weight of the condensate will cause the condensate droplets to flow along the axial length of the fins of the heat exchanger into condensate collection means. Hence, the condensate will not drip randomly from the coil but will flow along the axial length of the fin toward a condensate collection pan. Then the condensate may be drained from the unit from a single collection area.

Another approach to the condensate problem is to provide a fin surface having ridges and grooves designed to direct collected condensate along the axial length of the fin when the heat exchanger is mounted at an angle insufficient for the mere weight of the condensate to cause the condensate to flow along the fin. U.S. Pat. No. 3,902,551 discloses such a fin arrangement wherein the fin includes channels for conducting collected condensate to the condensate collection area.

As is known in the art, it has been found that a wavy fin surface is advantageous for promoting heat transfer between the air flowing through the heat exchanger and the cooling medium flowing through the tubes connected to the fins. This wavy surface forces a turbulent type air flow through the heat exchanger causing the air to be mixed and acts to promote heat transfer between the air and the fin surfaces while causing a minimum of pressure drop in the air flowing therethrough.

It has additionally been found that one of the highly efficient ways of circulating air through a heat exchanger is to cause the air to be blown through the heat exchanger utilizing a centrifugal fan. To reduce the pressure drop or flow resistance of the air flowing through the heat exchanger and to create an advantageous velocity profile across the heat exchanger, it has been found that mounting the heat exchanger horizontally across the air flow path or close to horizontally, and spaced from the fan discharge both reduces the overall flow resistance of the heat exchanger and allows for a desirable velocity profile. Naturally, when mounting a heat exchanger within a particular size casing, the maximum possible length of the heat exchanger is less when mounted horizontally than it would be if the heat exchanger was mounted at an angle to the horizontal. Hence, a heat exchanger mounted at a small angle to horizontal is found to be more efficient in terms of the size of the heat exchanger and the pressure drop of air flowing therethrough. The combination of mounting the heat exchanger at relatively small angle to horizontal as well as using a wavy type fin in the heat exchanger serves to promote a highly efficient heat exchanger with a minimum pressure drop. It has further been found that by mounting the blower below the heat exchanger such that air is blown through the heat exchanger that the fan scroll for the blower may be designed to optimize fan performance.

When the fan is mounted above the heat exchanger such that it is a draw-through heat exchanger, the fan scroll typically is arranged to direct the air from the unit into a duct. Under these circumstances, the fan scroll outlet is typically sized as a compromise between optimum for air flow purposes and what is necessary for duct purposes. Hence, aerodynamic inefficiencies may occur. By mounting the fan below the heat exchanger, the outlet of the fan coil unit may be appropriately sized to the duct work to minimize aerodynamic inefficiencies.

By the combination of utilizing a centrifugal fan located to blow air through the indoor heat exchanger, said indoor heat exchanger including a wavy type fin, the indoor heat exchanger being mounted at an angle substantially close to horizontal, and utilizing an outlet from a fan coil unit designed to match with the duct work to minimize aerodynamic inefficiencies it has been found that the watts consumed by the electric motor driving the fan per thousand cubic feet of air delivered can be reduced substantially in half from the fan watts utilized in present commercially available fan coil units. This reduction in fan watts reduces the total energy consumed by an air conditioning system to transfer a given amount of heat energy to effect cooling thereby increasing the efficiency of the unit.

When the heat exchanger is mounted at a low angle to horizontal and includes no channels for directing condensate along the axial length of the fins then the condensate will drip substantially across the entire heat exchanger surface. The herein application discloses a combination fan deck and condensate collection pan extending across the unit to receive the condensate dripping from the unit. Additionally, condensate will drip through a fan scroll opening in the combination fan deck and condensate pan and into the fan scroll wherein the squirrel cage rotor of the centrifugal fan is located. During operation of the unit the air flow from the fan will serve to prevent condensate from dripping into the fan and will tend to force any collected condensate from the fan scroll. There has additionally been provided a drain collection system for collecting condensate from the condensate pan. This drain collection system also includes means for collecting condensate from the bottom of the fan scroll which may accumulate when the fan is not operating. Hence, any problems of collected condensate causing corrosion or forming pools in unwanted areas are avoided by the utilization of a combination collection means to divert condensate from both the combination condensate pan and fan deck and the fan scroll.

SUMMARY OF THE INVENTION

It is an object of the present invention to provide a fan coil unit suitable for use in cooling air to be conditioned.

It is another object of the present invention to provide a fan coil unit that is highly efficient in terms of energy consumption for directing air through the unit.

It is yet another object of the present invention to provide a highly efficient fan coil unit having a heat exchanger mounted at an angle close to horizontal to reduce the pressure drop of air being circulated through the heat exchanger and to develop an ideal velocity profile for air flow through the heat exchanger.

It is a yet further object of the present invention to provide condensate collection means extending across the entire unit including a fan scroll for collected condensate.

It is a still further object of the present invention to provide a fan coil unit which is aerodynamically designed to reduce the fan power required to circulate air therethrough.

It is a further object of the present invention to advantageously utilize blow-through fan operation with a cooling heat exchanger.

A yet other object of the present invention is to arrange the components of a fan coil unit to allow the outlet of the unit to be advantageously sized relative to the duct to which the unit may be connected.

Another object of the present invention is to provide a safe, economical, reliable and easy to manufacture fan coil unit.

These and other objects of the present invention are provided by utilizing a fan coil unit having a housing defining an air flow path between an inlet and an outlet. A heat exchanger is mounted within the housing to extend across the air flow path. A blower assembly, including a fan scroll and a blower, is mounted within the housing vertically below the heat exchanger for blowing air through the heat exchanger. A combination fan deck and condensate pan defining a fan discharge opening for the blower assembly and serving as a condensate collection pan for condensate dripping from the heat exchanger is mounted below the heat exchanger. Drain means are connected to both the combination fan deck and condensate pan and the fan scroll for conducting collected condensate from the condensate pan and fan scroll from the unit are provided.

Additionally it can be seen that the heat exchanger is mounted at a sufficiently small angle to horizontal such that the condensate drips from the fins across the entire surface of the heat exchanger and such that the fins do not contain condensate conducting channels. Additionally, the outlet of the fan coil unit is designed to be aerodynamically efficient without regard to the necessary requirements of a scroll serving a centrifugal fan.

DESCRIPTION OF THE PREFERRED EMBODIMENT

The apparatus as described herein will be referred to as a blow-through fan coil unit. It is to be understood that this invention has like applicability to similar types of units utilized for similar purposes. Although described relative to use for air conditioning it is to be understood that this fan coil would have like applicability to any application for cooling or heating air wherein unwanted condensate may collect.

Figure 1:
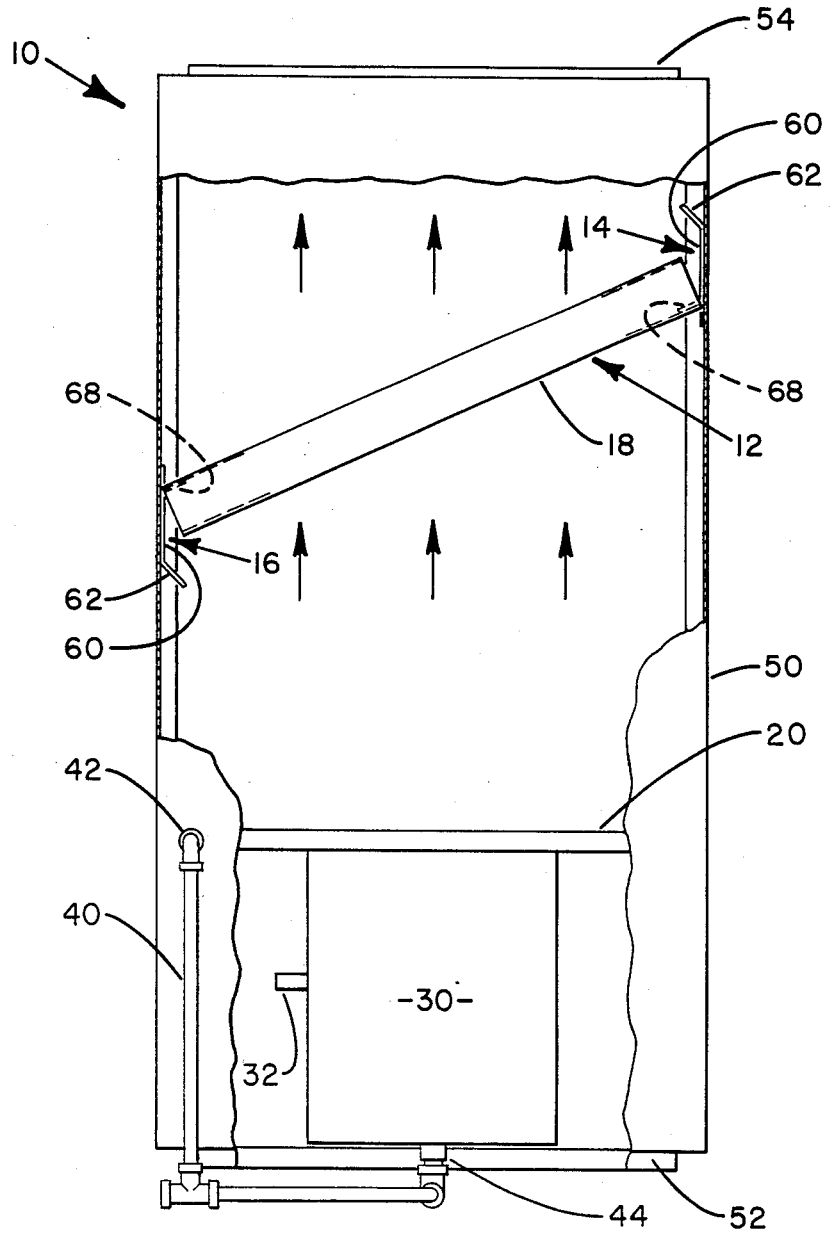
FIG. 1 is a partially cutaway front view of a fan coil unit.

Referring now to FIG. 1 there can be seen fan coil unit 10 having indoor heat exchanger 12 mounted to extend across the air flow path. Indoor heat exchanger 12 forms a relatively small angle with horizontal. Arrows are shown indicating the vertical air flow path of the unit. Heat exchanger 12 is supported by upper support 14 and lower support 16 to the housing 50 of the unit. The fan coil unit 10 is defined by housing 50 having a lower duct connector 52 and an upper duct connector 54 defining inlet and outlet openings. Fan scroll 30 is shown located at the bottom of the unit for coordinately acting with a fan (not shown) mounted to fan shaft 32 for causing air to be circulated upwardly through the heat exchanger. A combination fan deck and condensate pan 20 extends across the unit located at the same height as the fan discharge. The combination fan deck and condensate pan serves to collect condensate dripping from the coil surface and prevents air discharged from the fan from circulating back to the fan inlet. Drain line 40 is shown connected to combination fan deck and condensate pan 20 via condensate pan drain connector 42 and to the bottom of fan scroll 30 at fan scroll drain connection 44.

Figure 2:
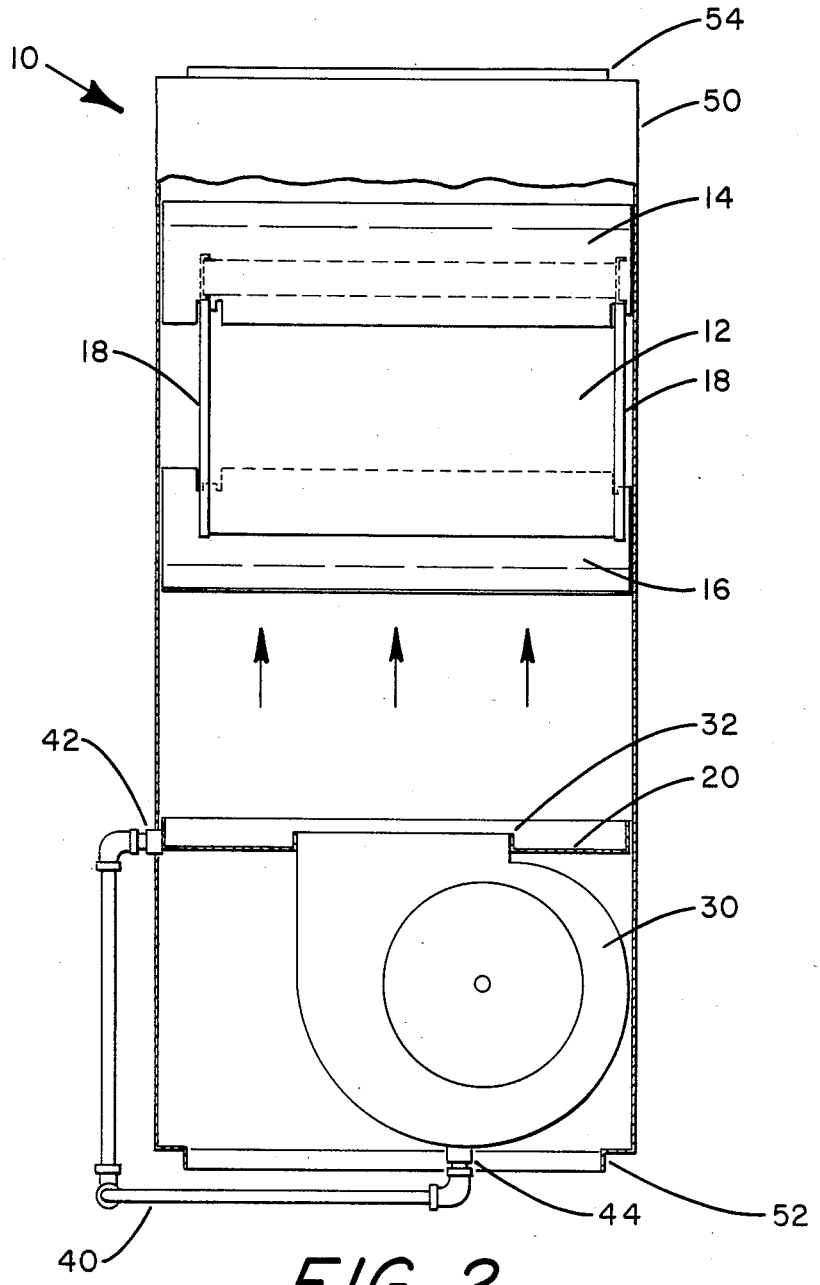
FIG. 2 is a partially cutaway side view of a fan coil unit.

FIG. 2 is a side view of the same fan coil unit as FIG. 1. Therein, the same components are labeled. Heat exchanger 12 is shown secured by top support 14 and lower support 16 to the fan coil unit. Fan discharge 32 is shown extending through a portion of combination fan deck and condensate pan 20. Hence, it may be seen that fan discharge portion 32 of fan scroll 30 is utilized to direct the air being circulated by the fan upwardly through the indoor heat exchanger and out the unit through outlet or upper duct connector 54. Condensate is diverted from the combination condensate pan and fan deck 20 and from the bottom of fan scroll 30 through drain line 40 to a drain or other appropriate disposal area.

The fan coil unit as shown provide for a highly efficient fan coil unit wherein the heat exchanger is arranged to have condensate drip from the entire cross section of the heat exchanger. This condensate drips downwardly into the condensate pan and into the fan scroll. From these two collection sources, the water is diverted to an appropriate disposal area. By allowing the coil to drip across this entire surface, the pressure drop of the air circulating through the heat exchanger is reduced since the angle between the heat exchanger and the direction of the flow of the air is increased providing a shorter air flow path through the heat exchanger. Other aerodynamic efficiencies are obtained by utilizing an outlet configured to be efficient with an appropriately sized duct.

The invention has been described with reference to a particular embodiment. It is to be understood by those skilled in the art that variations and modification can be effected within the spirit and scope of the invention.

What is claimed is:

1. A fan coil unit which comprises:

a housing defining an air flow path between an inlet and outlet;

a heat exchanger mounted within the housing to extend across the air flow path;

a blower assembly including a fan scroll and a blower mounted within the housing vertically below the heat exchanger for blowing air through the heat exchanger;

a combination fan deck and condensate pan defining a fan discharge opening for the blower assembly and serving as a condensate collection pan for condensate dripping from the heat exchanger; and drain means connected to both the combination fan deck and condensate pan and the fan scroll for conducting collected condensate from the combination fan deck and condensate pan and from the fan scroll.

2. The apparatus as set forth in claim 1 wherein the heat exchanger is a cooling heat exchanger such that moisture condenses on the heat exchanger surfaces and wherein the heat exchanger further comprises fins mounted on tubes, said condensate collecting on the fins and dripping therefrom into the combination fan deck and condensate pan and the fan scroll.

3. The apparatus as set forth in claim 2 wherein the fins further comprise a generally planar surface enhanced for heat transfer purposes without defining condensate conducting channels.

4. The apparatus as set forth in claim 2 wherein the angle between the heat exchanger and horizontal is sufficiently small that condensate collected on the heat exchange surfaces drips downwardly from the heat exchange surfaces across substantially the entire air flow path.

5. The apparatus as set forth in claim 2 and wherein the housing outlet is sized sufficiently large to minimize flow resistance of the air being circulated therethrough.

6. A blow-through fan coil unit which comprises:

a vertically extending housing defining an air flow path for air to be conditioned;

a heat exchanger mounted within the housing to extend across the air flow path for transferring heat energy between air flowing through the air flow path and a fluid flowing through the heat exchanger, said heat exchanger being mounted to define an angle with a horizontal plane that is sufficiently small that condensate collected on the surface of the heat exchanger drips downwardly over substantially the entire heat exchanger and such that the pressure drop of the air flowing through the heat exchanger is reduced;

a blower means including a fan scroll for forcing air to be conditioned upwardly through the heat exchanger;

a combination condensate pan and fan deck defining a blower means discharge opening for the air being circulated therethrough and a condensate collection pan extending across the housing to receive condensate dripping from the heat exchanger; and condensate removal means connected to the combination condensate pan and fan deck, and fan scroll for conducting condensate from the unit.

7. The apparatus as set forth in claim 6 wherein the heat exchanger further comprises a plate fin heat exchanger having fins mounted on tubes and wherein said fins are planar sheets deformed to enhance heat transfer without being configured to provide condensate conducting channels.

* * * * *